US006063419A

United States Patent [19]

Roche et al.

[11] Patent Number: 6,063,419

[45] Date of Patent: May 16, 2000

[54] YOGURT PRODUCT

[75] Inventors: Patrick Roche, County Wexford; Darvree Downey, Waterford, both of Ireland

[73] Assignee: Waterford Creamery Limited, Dungarvan, Ireland

[21] Appl. No.: 09/066,328

[22] PCT Filed: Oct. 31, 1996

[86] PCT No.: PCT/IE96/00069

§ 371 Date: Aug. 20, 1998

§ 102(e) Date: Aug. 20, 1998

[87] PCT Pub. No.: WO97/16072

PCT Pub. Date: May 9, 1997

[30] Foreign Application Priority Data

Oct. 31, 1995 [IE] Ireland ..... 950845
Feb. 29, 1996 [IE] Ireland ..... 960175

[51] Int. Cl.[7] ..... A23C 9/13; A23C 9/156; A23C 23/00

[52] U.S. Cl. ..... 426/130; 426/583; 426/394

[58] Field of Search ..... 426/34, 130, 302, 426/534, 583, 650, 394, 424

[56] References Cited

FOREIGN PATENT DOCUMENTS 64-16553 10/1989 Japan .

*Primary Examiner*—Keith Hendricks
*Attorney, Agent, or Firm*—Jacobson, Price, Holman, Stern, PLLC

[57] ABSTRACT

Flavoring is applied by a nozzle to four locations around a transparent sidewall of a yogurt container at a first filling station. At a second filling station, yogurt base is delivered to a base of the container. A raised portion at the base of the container assists in creating turbulence to disperse the flavoring into a desired ripple pattern which may be viewed through the transparent sidewall of the container.

12 Claims, 3 Drawing Sheets

YOGURT PRODUCT

FIELD OF THE INVENTION

The invention relates to a food product and in particular to a process for and an apparatus used in preparing a flavored yogurt product.

BACKGROUND OF THE INVENTION

Various flavored yogurt products are known. There is however a major difficulty in providing a yogurt product with a desired distribution of flavoring in the product.

SUMMARY OF THE INVENTION

According to the invention, there is provided a process for preparing a flavoured yoghurt product comprising the steps of:

preparing a yogurt base;

preparing an at least semi-liquid yogurt flavoring;

applying the flavoring to at least two spaced-apart locations in a yogurt container; and adding the yogurt base to the container for controlled partial dispersion of the flavoring to form a ripple pattern of flavoring in the yogurt base.

In a preferred embodiment of the invention the flavoring is applied to a sidewall of a yogurt container.

In a particularly preferred arrangement the flavoring is applied to four locations equi-spaced around a sidewall of a yogurt container.

In an especially preferred embodiment of the invention the flavoring is applied through a spray nozzle. Preferably the spray nozzle has a separate discharge outlet for delivery of the flavoring to a desired location in a yogurt container. Ideally, the spray nozzle has four discharge outlets for delivery of the flavoring to four spaced-apart locations in a yoghurt pot.

In a preferred embodiment of the invention the flavoring is discharged through a discharge outlet having a diameter of from 0.5 mm to 2 mm, most preferably approximately 1 mm.

In one embodiment of the invention the flavoring base is added to the base of a container to create a controlled turbulence for desired spreading of the applied flavoring.

Preferably a base of the yogurt container includes a central raised portion to assist in controlled spreading of the yogurt base evenly to create a controlled turbulence for desired spreading of the applied flavoring.

Preferably the yogurt container is of transparent material for viewing the ripple effect through the pot.

In one arrangement there are four adjacent yogurt containers and the process includes the step of applying a different flavoring to at least some of the containers. Preferably a different flavoring is applied to each yogurt container.

The invention also provides a flavored yogurt product whenever produced by the process of the invention.

The invention also provides an apparatus for preparing a flavored yogurt product by the process of the invention, the apparatus comprising a spray nozzle for applying semi-liquid yogurt flavoring to at least two spaced-apart desired locations in a yogurt container, the spray nozzle having at least two spaced-apart discharge outlets corresponding to the desired locations.

Most preferably the spray nozzle has four discharge outlets.

In a particularly preferred embodiment of the invention each discharge outlet has a diameter of from 0.5 mm to 2 mm, most preferably approximately 1 mm.

In a preferred embodiment of the invention the apparatus includes means for applying a yogurt base to the base of a yogurt container after application of the semi-liquid yogurt flavoring to create a controlled turbulence for desired spreading of the applied flavoring.

Preferably a base of the yogurt container includes a central raised portion to assist in controlled spreading of the yogurt base evenly to create a controlled turbulence for desired spreading of the applied flavoring.

BRIEF DESCRIPTION OF THE DRAWINGS

The invention will be more clearly understood from the following description thereof given by way of example only with reference to the accompanying drawings, in which.

DETAILED DESCRIPTION OF THE PREFERRED EMBODIMENTS

Figure 1:
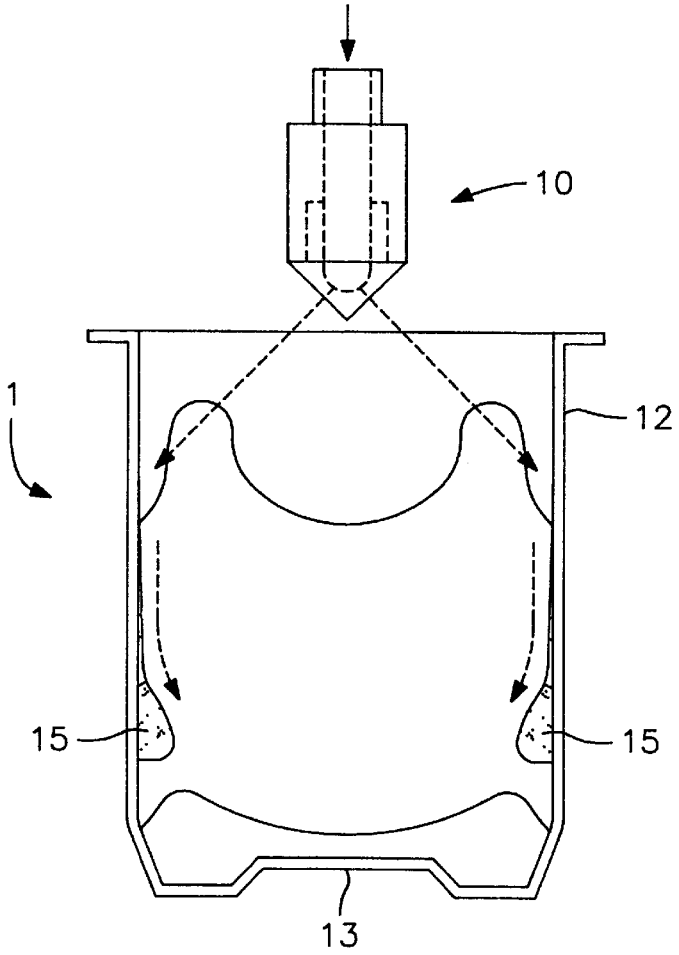
FIG. 1 is a side elevational view illustrating a flavoring applying step and apparatus of the invention.
Figure 3:
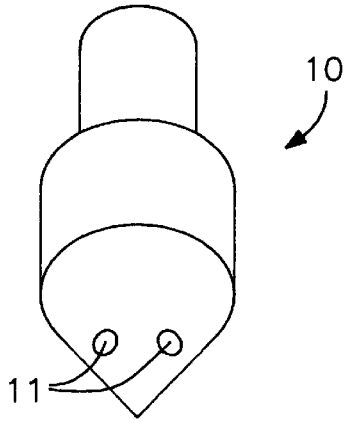
FIG. 3 is a perspective view of a nozzle used in the flavoring applying step.
Figure 4:
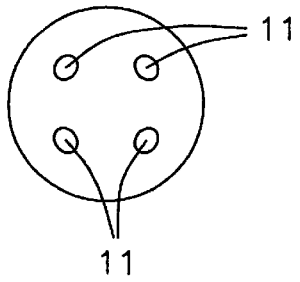
FIG. 4 is an underneath plan view of the nozzle of FIG. 3.
Figure 2:
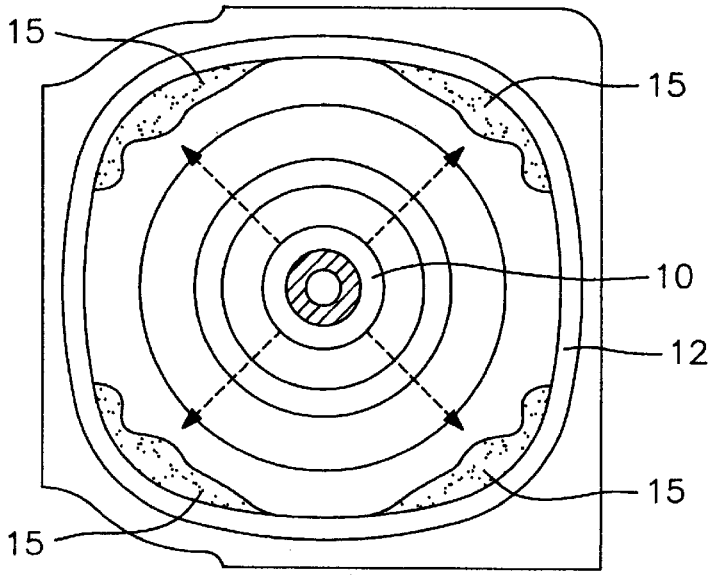
FIG. 2 is a plan view of the flavoring applying step of FIG. 1.

The invention provides a process for preparing a yogurt ripple product comprising a yogurt base with added fruit flavor which is partially dispersed through the yogurt to create a ripple effect when viewed through a transparent yogurt container 1. Four of the containers 1 are arranged in a four pack configuration 2 in which the flavor of the yogurt in adjacent containers 1 may be arranged as required. In this case each of the four containers 1 has a different flavor so that in a single pack 2 four different flavors such as Strawberry, Apple, Raspberry and Fruits of the Forest are provided.

In this case the yogurt base is a mild vanilla flavored yogurt which is prepared from milk at 2% fat, added milk proteins (whey protein and casein), sugar, skimmed milk powder and a gelling agent. The gelling agent is a mixture of gelatin and guar gum to achieve a soft gel which remains pourable during pre-filling storage and while filling but which forms a soft gel within approximately twelve hours of cooling. The yogurt is made with a mild culture which is a combination of *Lactobacillus acidophilis,* Bifidobacterin, and *Streptococcus thermophilus.*

The yogurt mixture is processed by first homogenizing the mixture in a two stage homogenization process. The pressure in the first stage is: 1800±100 psi. The pressure in the second stage is: 1000±100 psi. The homogenized mixture is then pasteurized at 92° C.±2° C. and then cooled to 40° C.±0.5° C. prior to inoculation. The mixture is filled into a fermentation tank where vanilla flavor is added and the mixture is agitated. The culture is then added at a rate which is typically 500 g per 2,000 liters of mixture. The yogurt is fermented to an acidity of 102±2° Doric. When the yogurt has the desired acidity, it is cooled in a plate heat exchanger to 23° C.±2° C. and held in a storage tank until required.

Flavoring is first added to an empty yogurt container 1. Referring particularly to FIGS. 1 to 4, the flavoring is applied to the pot 1 through a spray nozzle 10. The nozzle 10 has four equi-spaced-apart discharge outlets 11 which deliver flavoring 15 to four locations which are equally spaced-apart around a sidewall 12 of the container 1. Each of the discharge outlets 11 has a diameter of approximately 1 mm and the nozzle 10 is positioned in relation to the container 1 and the flow rate of flavoring is set to deliver a fine spray of flavoring to the sidewall 12 of the container 1.

Figure 5:
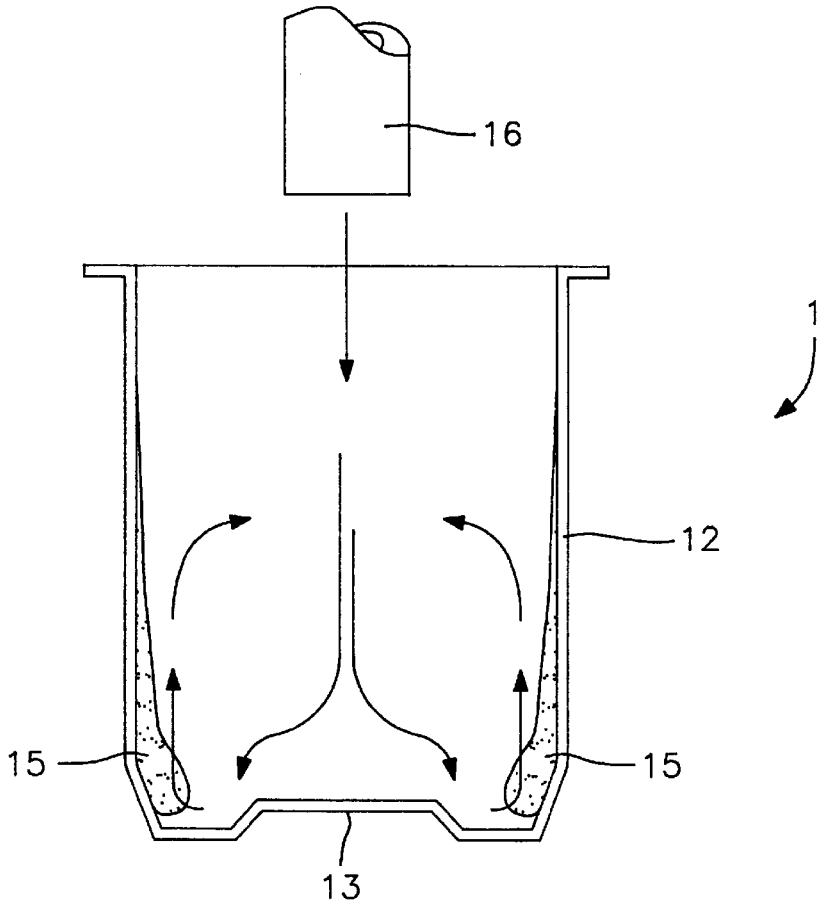
FIG. 5 is a side elevational view illustrating a yogurt filling step.
Figure 6:
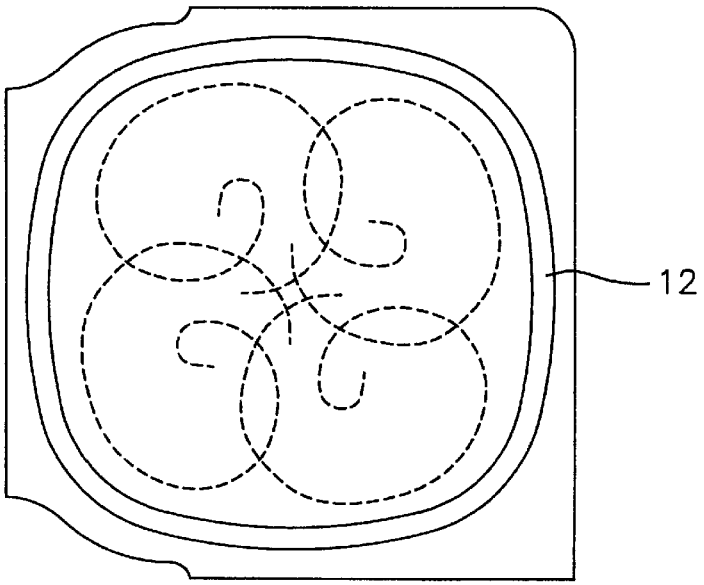
FIG. 6 is a plan view illustrating the yogurt filling step.
Figure 7:
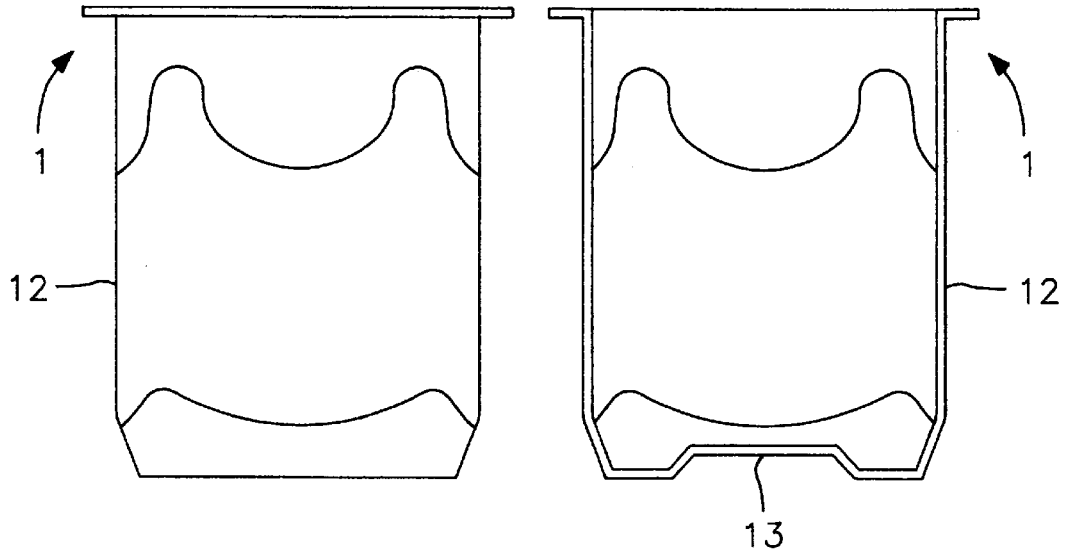
FIG. 7 are side views of a yogurt container used in the process.
Figure 8:
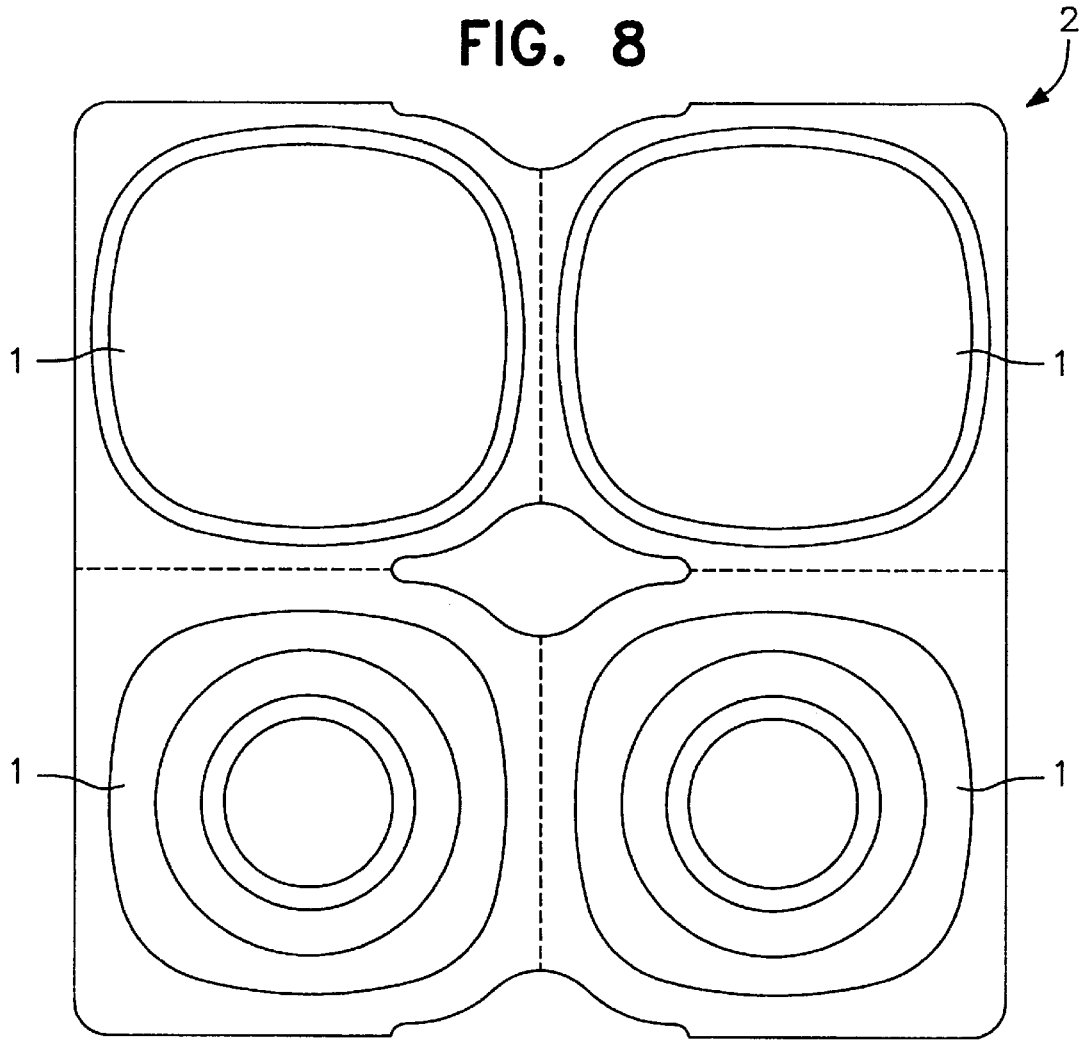
FIG. 8 is a plan view of a package of four adjacent yogurt containers containing flavored yogurt produced by the process of the invention.

At a second filling station illustrated in FIGS. 5 and 6 yogurt base prepared as described above is delivered to a base of the container 1 and into the flavoring in the container 1 through a delivery nozzle 16. A raised portion 13 at the base of the container 1 assists in creating a turbulence to disperse the flavoring into a desired ripple pattern.

In this case, the product is filled on a form-fill-seal machine. The yogurt containers 1 are formed, flavor is applied, yogurt base is delivered into the containers, a foil seal is placed and sealed. The containers 1 are arranged so that packs of four may be easily cut-off.

In this case, four different flavours are filled into yogurt containers from separate flavor hoppers. The hoppers are connected to the appropriate spray nozzle 10. A bank of spray nozzles 10 are positioned on a filling machine so that a separate flavor filling head is centered above the appropriate container 1. The nozzles 10 are positioned as illustrated in FIG. 1 to facilitate flavor dispersion.

Trays of filled and sealed containers are left to stand for approximately 1 hour at room temperature before they are moved into cold storage. After a minimum of twelve hours of cold storage, packs 2 of four containers are sleeved.

The invention provides a process and apparatus for effectively and efficiently preparing a flavored yogurt product with a desired ripple pattern of flavoring in a yogurt base.

Many variations on the specific embodiment of the invention will be readily appreciated and accordingly the invention is not limited to the embodiments hereinbefore described which may be varied in detail.

We claim:

1. A process for preparing a flavored yogurt product from a yogurt base and a semi-liquid flavoring comprising the sequential steps of:

preparing a yogurt base;

preparing an at least semi-liquid yogurt flavoring;

applying the flavoring to at least two spaced-apart locations in a yogurt container; and then adding the yogurt base to the container, wherein a base of the container includes a centrally raised portion to assist in controlled spreading of the yogurt base evenly to create a controlled turbulence, for controlled partial dispersion of the flavoring to form a ripple pattern of flavoring in the yogurt base.

2. A process as claimed in claim 1, wherein the flavoring is applied to a sidewall of the yogurt container.

3. A process as claimed in claim 2, wherein the flavoring is applied to four locations equi-spaced around a sidewall of the yogurt container.

4. A process as claimed in claim 1, wherein the flavoring is applied through a spray nozzle to a side wall of the yogurt container.

5. A process as claimed in claim 4, wherein the spray nozzle has a discharge outlet for delivery of the flavoring to a desired location in the yogurt container.

6. A process as claimed in claim 1, wherein the flavoring is applied through a spray nozzle having four discharge outlets for delivery of the flavoring to four spaced-apart locations in the yogurt container.

7. A process as claimed in claim 1, wherein the flavoring is applied through a spray nozzle having a discharge outlet having diameter of from 0.5 mm to 2 mm.

8. A process as claimed in claim 7, wherein the flavoring is applied through a spray nozzle having a discharge outlet having a diameter of approximately 1 mm.

9. A process as claimed in claim 1, wherein the yogurt container is of transparent material for viewing the ripple effect through the container.

10. A process as claimed in claim 1, wherein there are four adjacent yogurt containers and the process includes the step of applying a different flavoring to each of the containers.

11. Flavored yogurt product comprising:

a yogurt base, an at least semi-liquid flavoring, a yogurt container, the flavoring being applied to at least two spaced-apart locations in the yogurt container, and a base of the container including a centrally raised portion to assist in controlled spreading of the yogurt base evenly to create a controlled turbulence, for controlled partial dispersion of the flavoring to form a ripple pattern of flavoring in the yoghurt base.

12. A process as claimed in claim 4, wherein the flavoring is applied through a spray nozzle to four locations equi-spaced around a sidewall of a yogurt container.

* * * * *